United States Patent [19]

Burckhartzmeyer

[11] Patent Number: 4,757,685

[45] Date of Patent: Jul. 19, 1988

[54] PRESSURE RESPONSIVE HYDRAULIC CONTROL CIRCUIT

[75] Inventor: Jerry J. Burckhartzmeyer, Peoria, Ill.

[73] Assignee: Caterpillar Inc., Peoria, Ill.

[21] Appl. No.: 88,448

[22] Filed: Aug. 24, 1987

[51] Int. Cl.[4] ..... F15B 13/04

[52] U.S. Cl. ..... 60/452; 91/436; 137/596.2

[58] Field of Search ..... 60/452; 91/436; 137/596.2

[56] References Cited

U.S. PATENT DOCUMENTS

| | | | |
|---|---|---|---|
| 3,601,504 | 8/1971 | McBurnett | 417/213 |
| 3,722,543 | 3/1973 | Tennis | 137/596 |
| 3,908,843 | 9/1975 | Noller . | |
| 4,007,845 | 2/1977 | Worback . | |
| 4,344,733 | 8/1982 | Hirsch | 414/694 |
| 4,354,351 | 10/1982 | Dezelan | 60/456 |

FOREIGN PATENT DOCUMENTS 0009974 4/1980 European Pat. Off. .

0229330 7/1987 European Pat. Off. .

OTHER PUBLICATIONS

Rexroth-Directional Control Valve MP-18 (30 Series)- Issue Date: 4/80.

*Primary Examiner*—Gerald A. Michalsky
*Attorney, Agent, or Firm*—John W. Grant

[57] ABSTRACT

Backhoes are useful for digging trenches, ditches, etc. However, a performance deficiency caused by the formation of voids in the hydraulic control motor occurs sometimes if the swinging mass of the backhoe is abruptly stopped by quickly moving the directional control valve to the neutral position. The present invention provides a control circuit having a charging valve for communicating pressurized fluid from the supply conduit connected to the pump to charge the makeup valves with pump discharge fluid to minimize or avoid the formation of voids when the directional control valve is moved to the neutral position to stop the swinging movement of the backhoe mechanism.

8 Claims, 1 Drawing Sheet

PRESSURE RESPONSIVE HYDRAULIC CONTROL CIRCUIT

TECHNICAL FIELD

This invention relates generally to a pressure responsive hydraulic control circuit and more particularly to a circuit for supplying pressurized fluid to a pair of makeup valves.

BACKGROUND ART

The position of a boom of a backhoe is commonly controlled by a pair of hydraulic jacks connected between a main support frame and a boom support frame. The boom is swung in an arcuate path about its pivotal connection to the main frame generally by extending one of the jacks and retracting the other jack. The boom control circuit is normally provided with a pair of line relief valves and a pair of makeup valves connected to the respective lines connecting a control valve to the hydraulic jacks. The line relief valve functions to vent fluid from one of the lines when excessive pressure is generated therein while the makeup valves function to provide makeup fluid to a line if it becomes cavitated.

One of the problems sometimes encountered therewith occurs when the swinging motion of the boom is abruptly stopped by moving the control valve to its neutral position and the inertia of the boom and the other components supported thereby generates fluid pressure in one of the lines sufficient to open the relief valve thereby allowing fluid to be expelled from that line. This results in the other line being cavitated. While the makeup valves directs most of the expelled fluid into the cavitated line, some of the expelled fluid leaks past other valves in the system and not all of the expelled fluid is reclaimed such that a void is created on one side of the hydraulic jacks. This void then allows the boom to rebound or bounce from side to side a small amount until the inertia energy is dissipated. This is a performance deficiency sometimes referred to as "swing wag".

The present invention is directed to overcoming the problem as set forth above.

DISCLOSURE OF THE INVENTION

In one aspect of the present invention, a pressure responsive hydraulic control circuit for controlling a hydraulic motor comprises a directional control valve having an inlet port, an outlet port and a pair of motor ports. The control valve is moveable between a neutral position at which the ports are all isolated from one another and an operating position at which the inlet port is in communication with one of the motor ports and the other motor port is in communication with the outlet port. A supply conduit connects a source of variable pressure fluid to the inlet port. A pair of motor conduits connect the motor ports with the opposite sides of the hydraulic motors. A pair of makeup valves are connected to the respective motor conduits and an exhaust conduit. A means is provided for communicating pressurized fluid from the supply conduit to the exhaust conduit when the directional control valve is in its neutral position.

The present invention provides a hydraulic control circuit which utilizes the pressurized fluid from the main supply conduit upstream of the directional control valve to super charge the makeup valves when the directional control valve is in its neutral position. By super charging the makeup valves, any fluid lost from the associated circuit is immediately replenished thereby avoiding or minimizing the creation of voids in the hydraulic jacks.

BEST MODE FOR CARRYING OUT THE INVENTION

Figure 1:
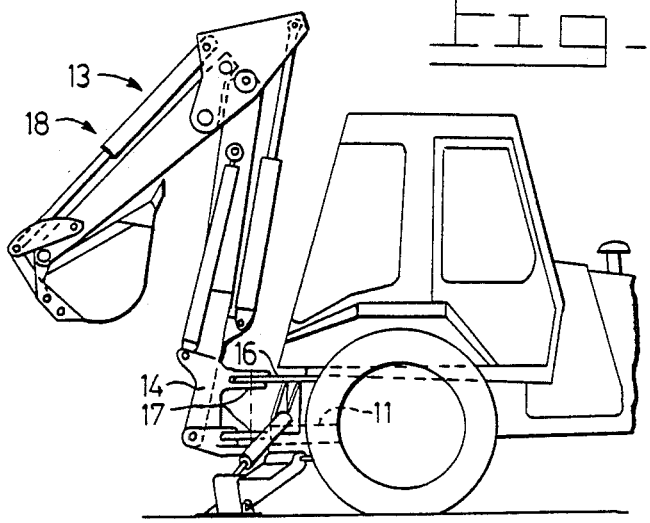
FIG. 1 is a side view of a backhoe embodying the principles of the present invention.

A pressure responsive hydraulic control circuit 10 controls fluid flow to and from a pair of hydraulic motors 11, 12. In the present invention the hydraulic motors are the swing control hydraulic jacks of a backhoe 13 having a boom support frame 14 pivotally connected to a main frame 16 about vertically aligned pivot joints 17 in the usual manner. The hydraulic jacks 11,12, only one of which is shown in FIG. 1, are connected between the main frame 16 and the boom support frame 14. The boom support frame and thus a backhoe mechanism 18 mounted thereon is swingable about the pivot joints 17 by extending one of the hydraulic jacks and retracting the other jack in the usual manner.

Figure 2:
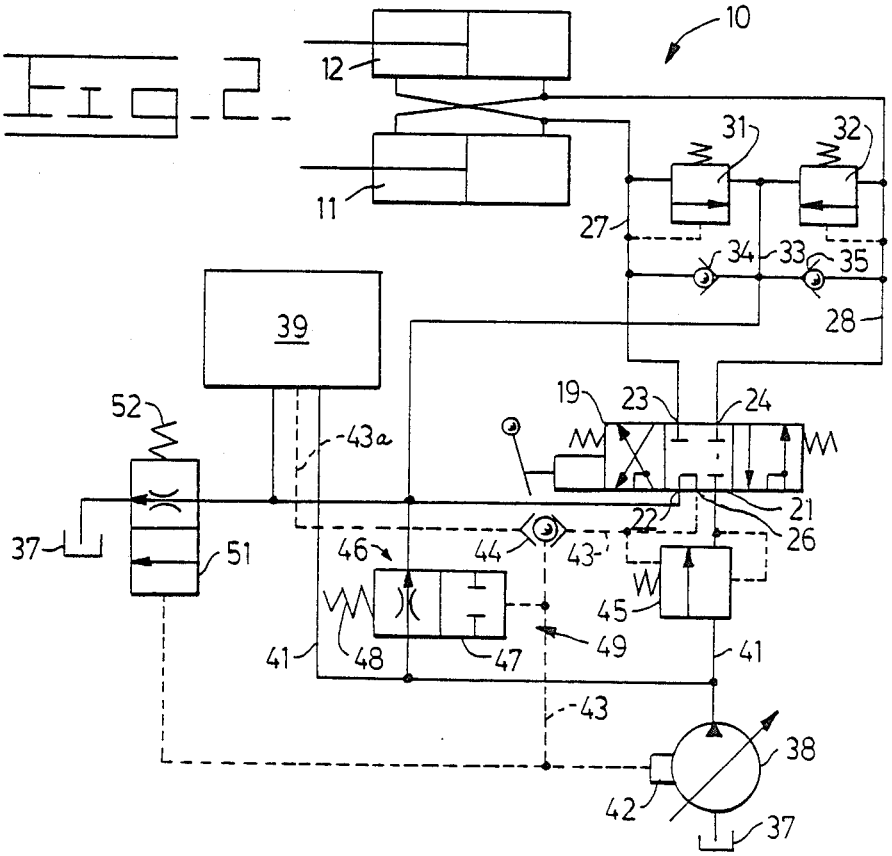
FIG. 2 is a schematic representation of an embodiment of the present invention.

The control circuit 10 includes a directional control valve 19 having an inlet port 21, an outlet port 22, a pair of motor ports 23,24, and a load pressure signal port 26. The directional control valve 19 is moveable between the neutral position, as shown in FIG. 2, rightwardly to a first operating position and leftwardly to a second operating position. At the neutral position, the inlet port 21, the outlet port 22, and the motor ports 23,24 are all isolated from one another and the load pressure signal port 26 is in communication with the outlet port 22. At the first operating position, the motor port 23 is in communication with the inlet port 21 and the signal port 26 and the motor port 24 is in communication with the outlet port 22. At the second operating position, the motor port 24 is in communication with the inlet port 21 and the signal pressure port 26 and the motor port 23 is in communication with the outlet port 22.

A first motor conduit 27 connects the motor port 23 with the head end of the hydraulic jack 11 and the rod end of the hydraulic jack 12. Similarly, a second motor conduit 28 connects the motor port 24 with the head end of the hydraulic jack 12 and the rod end of the hydraulic jack 11. A pair of line relief valves 31,32 are connected to the respective motor conduits 27,28 and to a common conduit 33. A pair of makeup valves 34,35 are also connected to the respective motor conduits 27,28 and to the common conduit 33. The common conduit 33 in this embodiment is an exhaust conduit connected to the outlet port 22 of the directional control valve 19 and to a fluid reservoir 37.

A variable displacement pressure compensated pump 38 is connected to the inlet port 21 of the directional control valve 19 and to one or more other implement circuits 39 of the backhoe 13 through a supply conduit 41. The pump 38 provides a source of variable pressure fluid to the control circuit 10 and has a displacement control 42 integral therewith. A load pressure signal line 43 is connected to the load pressure signal port 26 of the directional control valve and to the displacement control 42 through a resolver 44. Another load pressure signal line **43*a* connects the implement circuit 39** to the resolver 44. A pressure compensated flow control valve 45 is disposed in the supply conduit 41.

The control circuit 10 also includes a means 46 for communicating pressurized fluid from the supply conduit 41 to the common conduit 33 when the directional control valve 19 is in the neutral position. The communicating means 46 can include for example, a charging valve 47 connected to the supply conduit 41 and the common conduit 33 and being movable between a first position at which restricted communication is provided between the supply conduit and the common conduit and a second position at which the supply conduit is blocked from the common conduit. The charging valve includes a spring 48 disposed at one end for resiliently biasing the charging valve 47 to the first position. The load pressure signal line 43 is connected to the other end of the charging valve.

A means 49 is provided for moving the charging valve 47 to the second position when the directional control valve 19 is moved to one of the operating positions. The moving means 49 includes the load pressure signal port 26 of the directional control valve 19 and the load pressure signal line 43.

The communicating means 46 also can include a regeneration valve 51 disposed in the common conduit 33 between the point at which the charging valve 47 is connected to the common conduit and the reservoir 37. The regeneration valve 51 is moveable between a first position at which fluid flow therethrough is restricted and a second position at which fluid flow therethrough is substantially unrestricted. The regeneration valve has one end connected to the load signal line 43 and includes a spring 52 disposed at the other end for resiliently biasing the regeneration valve to the first position.

INDUSTRIAL APPLICABILITY

In operation, the backhoe mechanism 18 is swung in a first direction about the pivot joints 17 by moving the directional control valve 19 to the first operating position. At such position, pressurized fluid from the supply conduit 41 is directed through the motor conduit 27 to extend the hydraulic jack 11 and to retract the hydraulic jack 12. The fluid exhausted from the hydraulic jacks passes through the motor conduit 28 and the directional control valve 19 and into the common conduit 33. Pressurized fluid equivalent to the load pressure in the motor conduit 27 is transmitted through the signal port 26 and into the load pressure signal line 43 as a load pressure signal which moves the charging valve 47 and the regeneration valve 51 to their respective second positions. At the second position of the regeneration valve, the exhaust fluid in the common conduit 33 passes substantially unrestricted therethrough to the tank 37. The charging valve 47 at the second position thereof blocks flow of pressurized fluid from the supply conduit 41 to the common conduit 33.

The load pressure signal in the signal line 43 is also transmitted to the displacement control 42 of the pump 38 and to one end of the pressure compensated flow control valve 45. The displacement control reacts to the load pressure signal to maintain the fluid pressure in the supply conduit 41 at a predetermined pressure differential greater than the load pressure at the motor port 23 in the usual manner. The flow control valve 45 reacts to the load pressure signal to maintain a constant pressure differential across the directional control valve 19 in the usual manner.

The directional control valve 19 is returned to the neutral position to stop the swinging motion of the backhoe mechanism 18. The directional control valve 19 at the neutral position blocks communication of fluid between the motor ports 23,24, the inlet port 21 and the outlet port 22 and establishes communication between the load signal port 26 and the outlet port 22 to vent the pressurized fluid in the load signal line 43 through the common line 33 to the reservoir. This permits the charging valve 47 and the regeneration valve 51 to return to the first positions shown. If the movement of the directional control valve 19 to the neutral position is done very quickly so that fluid flow in the motor conduits 27 and 28 is stopped very abruptly, the momentum of the swinging backhoe mechanism 18 immediately generates high pressure in the motor conduit 28 sufficient to open the line relief 32. The opening of the line relief 32 causes fluid to be expelled from the motor conduit 28 into the common conduit 33. Simultaneously, a void is created in the motor conduit 27. With the regeneration valve 51 in the first position, fluid flow therethrough is restricted so that most of the fluid expelled from the conduit 28 passes through the makeup valve 34 and into the motor conduit 27. Some of the fluid expelled from the motor conduit 28, however, passes through the regeneration valve 51 to the reservoir 37. However, with the charging valve 47 in the first position, fluid from the supply conduit 41 passes into the common conduit 33 upstream of the regeneration valve 31 to super-charge the makeup valves 34 and 35. This additional fluid passes through the makeup valve 34 into the motor conduit 27. Thus the charging valve 47 compensates for any fluid lost through the regeneration valve and maintains sufficient fluid in the common conduit 33 to prevent the creation of voids in the motor conduit 27.

Similarly, the backhoe mechanism 18 is swung in the opposite direction by moving the directional control valve 19 to the second operating position. The resultant action of the components of the control circuit are similar to that described above with the primary difference being that the fluid flow through the motor conduits 27 and 28 is reversed.

It is to be understood that if the directional control valve 19 and another of the implement circuits 39 are operated at the same time, the highest load pressure signal in either the signal line 43 or 43*a* will control the pressure in the supply conduit 41. Moreover when the directional control valve 19 is in the neutral position and another of the implement circuits 39 is operated, the load pressure signal in line 43*a* will move the charging valve 47 and the regeneration valve 51 to their second positions for normal operation of the total system.

In view of the foregoing it is readily apparent that the structure of the present invention provides an improved pressure responsive hydraulic control circuit which charges the makeup valve with pressurized fluid from the pump by way of the supply conduit and the charging valve when the directional control valve is moved to the neutral position. By using the discharge fluid to charge the makeup valves, makeup fluid is always available and thus prevents the hydraulic jacks from cavitating and thereby eliminates the swing wag condition when the backhoe mechanism is abruptly stopped.

Other aspects, objects, and advantages of this invention can be obtained from a study of the drawings, the disclosure, and the appended claims.

I claim:

1. A pressure responsive hydraulic control circuit for controlling a hydraulic motor comprising;

a directional control valve having an inlet port, an outlet port and a pair of motor ports, said control valve being movable between a neutral position at which the ports are all isolated from one another and an operating position at which the inlet port is in communication with one of the motor ports and the other motor port is in communication with the outlet port;

a source of variable pressure fluid;

a supply conduit connecting the source of variable pressure fluid to the inlet port;

a pair of motor conduits connecting the motor ports with the respective sides of the hydraulic motor;

a pair of makeup valves connected to the respective motor conduits;

an exhaust conduit connected to the pair of makeup valves; and means for communicating pressurized fluid from the supply conduit to the exhaust conduit and supercharging the makeup valves only when the directional control valve is in the neutral position.

2. The control circuit of claim 1 wherein said communicating means includes a charging valve connected to the supply conduit and the exhaust conduit and being movable between a first position at which restricted communication is provided between the supply conduit and the exhaust conduit and a second position at which the supply conduit is blocked from the exhaust conduit, said charging valve including a spring disposed at one end resiliently biasing the charging valve to the first position; and means for moving the charging valve to the second position when the control valve is moved to the operating position.

3. The control circuit of claim 2 wherein the moving means includes a load pressure signal port in the directional control valve and being in communication with the one motor port at the operating position of the directional control valve and in communication with the outlet port at the neutral position of the directional control valve, and a load pressure signal line connected to the load pressure signal port and the other end of the charging valve.

4. The control circuit of claim 3 wherein said exhaust conduit is connected to the outlet port, said communicating means including a regeneration valve disposed in the exhaust conduit and being movable between a first position at which fluid flow therethrough is restricted and a second position at which fluid flow therethrough is substantially unrestricted, said regeneration valve having one end connected to the load pressure signal line and including a spring disposed at the other end resiliently biasing the regeneration valve to the first position.

5. The control circuit of claim 4 wherein said source of variable pressure fluid includes a variable displacement pressure compensated pump having a displacement control connected to the load signal line.

6. A pressure responsive hydraulic control circuit for controlling a hydraulic motor comprising;

a directional control valve having an inlet port, an outlet port and a pair of motor ports, said control valve being movable between a neutral position at which the ports are all isolated from one another and an operating position at which the inlet port is in communication with one of the motor ports and the other motor port is in communication with the outlet port;

a source of variable pressure fluid;

a supply conduit connecting the source of variable pressure fluid to the inlet port;

a pair of motor conduits connecting the motor ports with the respective sides of the hydraulic motor;

a pair of makeup valves connected to the respective motor conduits;

a fluid reservoir;

an exhaust conduit connected to the pair of makeup valves and being in communication with the fluid reservoir;

means for communicating pressurized fluid from the supply conduit to the exhaust conduit only when the directional control valve is in the neutral position; and means for restricting fluid flow through the exhaust conduit to the fluid reservoir so that the makeup valves are super-charged only when the directional control valve is in the neutral position.

7. The control circuit of claim 6 wherein said communicating means includes a charging valve connected to the supply conduit and the exhaust conduit and being movable between a first position at which restricted communication is provided between the supply conduit and the exhaust conduit and a second position at which the supply conduit is blocked from the exhaust conduit, said charging valve including a spring disposed at one end resiliently biasing the charging valve to the first position; and means for moving the charging valve to the second position when the control valve is moved to the operating position.

8. The control circuit of claim 7 wherein the moving means includes a load pressure signal port in the directional control valve and being in communication with the one motor port at the operating position of the directional control valve and in communication with the outlet port at the neutral position of the directional control valve, and a load pressure signal line connected to the load pressure signal port and the other end of the charging valve.

* * * * *